US005224362A

United States Patent [19]

Sawazaki et al.

[11] Patent Number: 5,224,362

[45] Date of Patent: Jul. 6, 1993

[54] APPARATUS AND METHOD FOR WINDING AND DOFFING ROLL OF KNITTED CLOTH ON A CIRCULAR KNITTING MACHINE

[75] Inventors: Masatoshi Sawazaki; Koji Tsuchiya, both of Hyogo, Japan

[73] Assignee: Precision Fukuhara Works, Ltd., Japan

[21] Appl. No.: 912,915

[22] Filed: Jul. 13, 1992

Related U.S. Application Data

[63] Continuation-in-part of Ser. No. 756,170, Sep. 6, 1991, abandoned.

[30] Foreign Application Priority Data

Sep. 19, 1990 [JP] Japan ..... 2-251211

[51] Int. Cl.[5] ..... D04B 15/88

[52] U.S. Cl. ..... 66/151; 242/62

[58] Field of Search ..... 66/151, 152, 147, 148, 66/149 R; 242/62, 68.2, 72 R, 58.6

[56] References Cited

U.S. PATENT DOCUMENTS

| | | | |
|---|---|---|---|
| 3,855,822 | 8/1978 | Lee | 66/151 X |
| 4,069,688 | 1/1978 | Sanders | 66/151 X |
| 4,079,600 | 1/1978 | Amaya et al. | 66/151 X |
| 4,879,886 | 11/1989 | Okada et al. | 66/151 |
| 4,888,963 | 12/1989 | Scherzinger | 66/151 |
| 5,042,272 | 8/1991 | Furr | 66/151 |
| 5,136,859 | 8/1992 | Nitta | 66/151 |

FOREIGN PATENT DOCUMENTS

| | | | |
|---|---|---|---|
| 2005141 | 8/1971 | Fed. Rep. of Germany | 66/151 |
| 795368 | 5/1958 | United Kingdom | 66/151 |
| 2118979 | 11/1983 | United Kingdom | 66/151 |

*Primary Examiner*—Clifford D. Crowder
*Assistant Examiner*—Larry D. Worrell
*Attorney, Agent, or Firm*—Bell, Seltzer, Park & Gibson

[57] ABSTRACT

An automatic winding and doffing apparatus of a circular knitting machine includes a winding unit that revolves synchronously with the cylinder of the circular knitting machine. The apparatus includes opposed winding apparatus frame arms. A fabric winding roll has one roll end pivotally mounted on one of the arms. A guide mechanism guides the knitted fabric to the winding roll. The fabric roll is stopped after a predetermined amount of fabric has been wound. A doffing apparatus doffs the fabric from the winding roll after a predetermined amount of fabric has been wound on the fabric roll. In a preferred embodiment, the other winding roll end is freely supported by a turning lever pivotally mounted on the frame. Upon pivoting movement of the lever arm, the winding roller may be moved from a home, winding position to an unloading, doffing position in which the other end of the winding roller is removed from the support arm. A lock mechanism operatively connects to the turning lever for locking the turning lever in a position in which the turning lever supports the winding roller in the home, winding position and for unlocking the turning lever to allow the turning lever to pivot and disengage from the winding roller.

10 Claims, 11 Drawing Sheets

APPARATUS AND METHOD FOR WINDING AND DOFFING ROLL OF KNITTED CLOTH ON A CIRCULAR KNITTING MACHINE

RELATED APPLICATIONS

This application is a continuation-in-part of U.S. patent application Ser. No. 07/756,170, filed Sep. 6, 1991, now abandoned.

FIELD OF THE INVENTION

This invention relates to an apparatus for automatic winding and doffing of knitted cloth on a circular knitting machine.

BACKGROUND OF THE INVENTION

In conventional circular knitting machines, knitted cloth is flattened and wound on a winding roller supported by a winding unit. The winding unit revolves synchronously with the knitting machine cylinder and drives fabric delivery rolls through power transmission mechanisms which interconnect to the rotating winding unit. The knitted fabric is then wound into a flat sheet on the winding roll positioned beneath the delivery rolls. Typically, an operator manually unlocks the winding roll from a locked position relative to frame arms of the knitting machine, and removes the winding roll together with the knitted fabric wound thereon from the machine. In recent years, technology advances have enabled circular knitting machines to operate at increased speeds, particularly in those knitting machines that knit fabrics in full body size. As a result of these speed increases, the knitted fabric is wound faster and doffed in shorter cycles, creating excess and difficult work for the machine operator.

SUMMARY OF THE INVENTION

A primary object of the present invention is to provide an automatic winding and doffing apparatus and method for a circular knitting machine in which winding and doffing of the knitted fabric are achieved more efficiently and easily.

The apparatus and method of the invention employ a winding unit that revolves synchronously with the needle cylinder of the circular knitting machine. The winding unit is positioned below the needle cylinder and drives fabric delivery rolls through a power transmission mechanism interconnecting with the rotating winding unit.

A fabric winding roll positioned between opposed frame arms of the machine winds the knitted cloth. The winding roll has two opposing ends and includes means for changing the diameter of the roll to allow fabric wound thereon to be doffed from the roll. A plurality of combs are positioned on the surface of the roll. The combs are movable between a retracted position in which the combs are positioned below the surface of the roll to an extended position in which the combs project from the surface of the roll to engage the cloth and retain the cloth on the winding roll.

One end of the winding roll is pivotally connected to one of the frame arms. Guide means guides the knitted fabric onto the winding roll at the start of fabric winding. The combs catch the knitted fabric and secure the knitted fabric to the winding roll. Control means stops the winding roll after a predetermined amount of knitted fabric has been wound on the winding roll. Cutting means cuts the knitted fabric, and doffing means doffs fabric in the direction of the roll axis.

In a preferred embodiment a turning lever pivotally mounted on the frame supports the winding roll so that a free end of it may be moved from a home, winding position to an unloading, doffing position in which the free end of the winding roller is moved away from a support arm.

A locking means is operatively connected to the turning lever for locking the turning lever in a position in which the turning lever supports the winding roller in the home, winding position and for unlocking the turning lever to allow the turning lever to pivot and disengage from the winding roll.

A gate is positioned adjacent the winding unit between the frame arms for protecting and substantially covering the winding unit. The gate is automatically opened and closed during doffing of the knitted fabric from the winding roll.

The winding roll includes two channel members dividing the surface of the winding roll into two half sections. The half sections are movable relative to each other for changing the cross sectional size of the winding roll.

The winding roll includes guide channel members having holes therein. The half-section channel members engage the guide channel members and are guided along the holes. In a preferred embodiment, the locking means includes a cam on which the turning lever abuts, and includes motor means operatively connected to the cam for rotating the cam and turning the lever arm.

BRIEF DESCRIPTION OF THE DRAWINGS

The foregoing and other objects, features and advantages of the present invention will become apparent from the following detailed description of the preferred embodiment of the invention, and from the drawings, in which.

DETAILED DESCRIPTION OF THE PREFERRED EMBODIMENT

Figure 1:
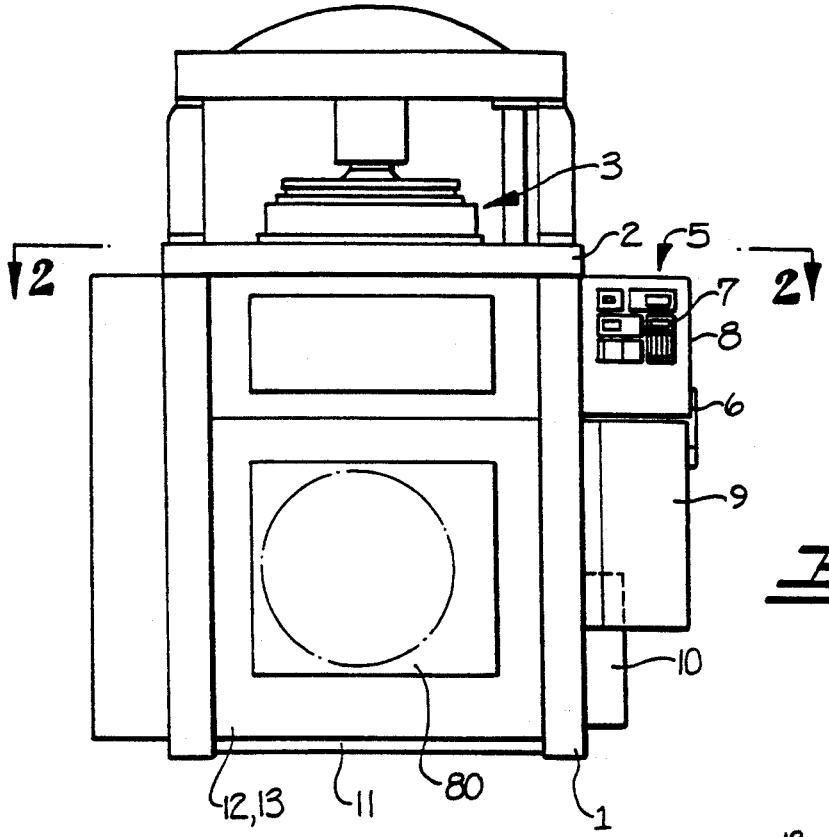
FIG. 1 is a front elevational view of the circular knitting machine in accordance with a preferred embodiment of the present invention.

FIG. 1 is a front elevational view of a circular knitting machine in accordance with the present invention. The circular knitting machine includes a knitting unit 3 mounted on a knitting bed 2 supported by legs 1. Legs 1 include Cross members 11 extending along the bottom. A winding unit 4 (FIG. 3) and drive mechanism 5 are positioned below the knitting unit. The drive mechanism 5 includes a motor 6 having a motor converter 8 with a digital panel 7 for displaying operating characteristics of the motor 6. An AC invertor motor control panel 9 (hereinafter referred to as "ACI motor control panel") and automatic doffer control panel 10 are located below mechanism 5.

Gates 12, 13 are secured between legs 1. Upper gate 12 can be opened and closed manually. Lower gate 13 includes a window 80 that can be automatically opened and closed for removing the cylindrically wound fabric positioned on winding unit 4.

Figure 3:
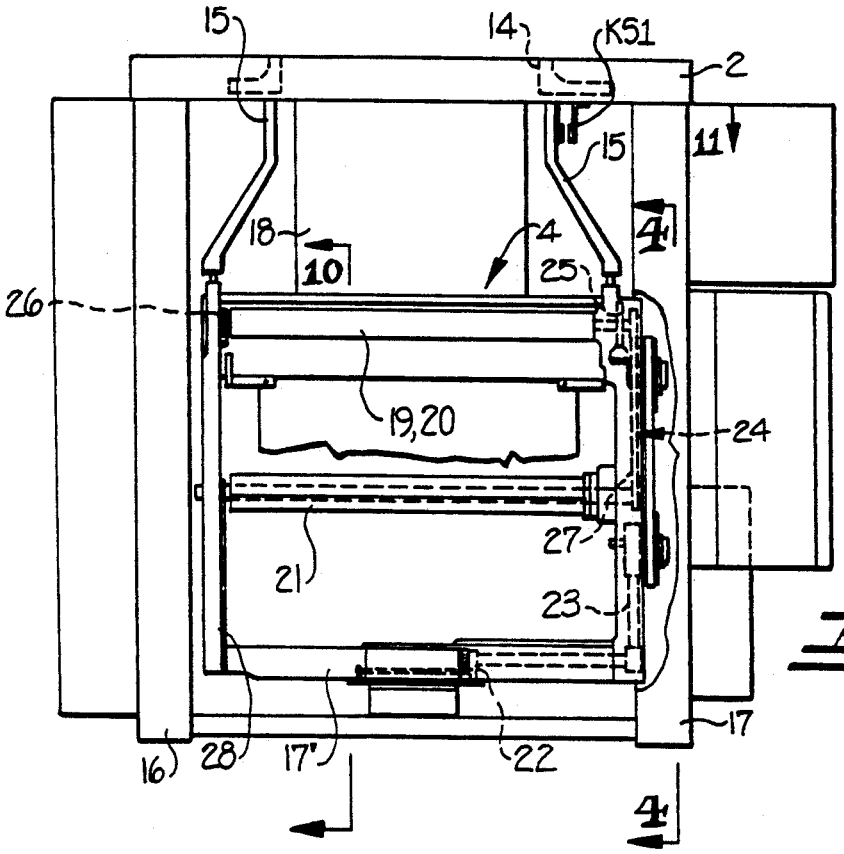
FIG. 3 is a front elevational view of the winding unit of the present invention.
Figure 10:
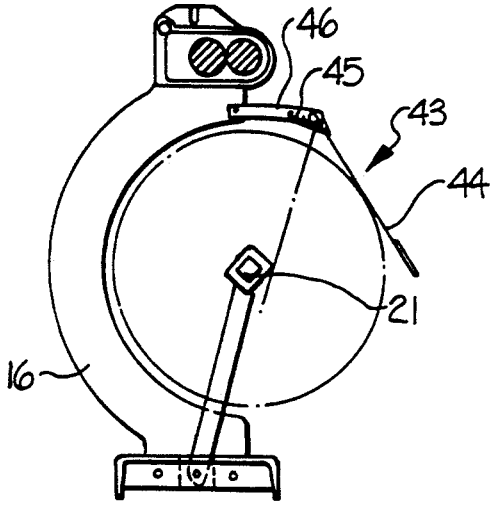
FIG. 10 is a sectional view of the fabric guide apparatus taken along line 10—10 of FIG. 3.

A rotatable ring gear 14 is contained in the knitting bed as, shown in FIG. 3. The knitting machine frame includes two opposed winding frame arms 16, 17 that rotate synchronously with the ring gear 14 via two connecting rods 15 connected at the bottom of the gearing 14. The winding frame arms 16, 17 are formed integrally with each other and are fixed on the bottom frame 17'. One of the frame arms 16 is semi-circular in shape to allow the fabric wound into a cylindrical package to be removed in a horizontal direction relative to the machine (FIG. 10).

As seen in FIG. 3, during knitting the knitted fabric 18 is delivered from the knitting unit 4 by at least two lines of delivery rolls 19, 20, and then wound on the winding roll 21. A proximity switch KSI positioned on the bottom of bed 2 detects the knitting machine speed by counting the number of revolutions per unit time.

Figure 4:
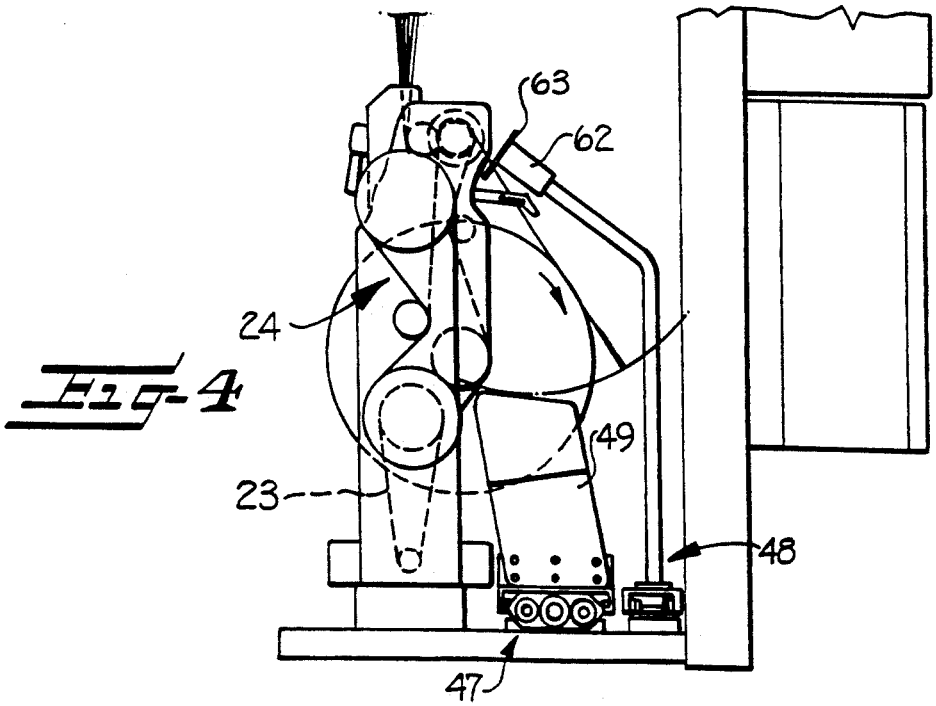
FIG. 4 is a side elevational view of the winding unit taken along line 4—4 of FIG. 3.

The drive mechanism 5 of winding unit 4 will now be described in greater detail. Referring to FIGS. 3 and 4, winding unit 4 rotates and drives the delivery rolls 19, 20 through a power transmission mechanism connected to the frame arms 16, 17. The power transmission mechanism includes a first bevel gear mechanism 22 that rotates as the winding unit 4 rotates. The mechanism includes a first belt 23, a variable speed pulley 24, and a worm 25 that rotates the delivery roll 19. A spur gear 16 rotates the delivery roll 20, and a belt 17 rotates the winding roll 21.

Figure 8:
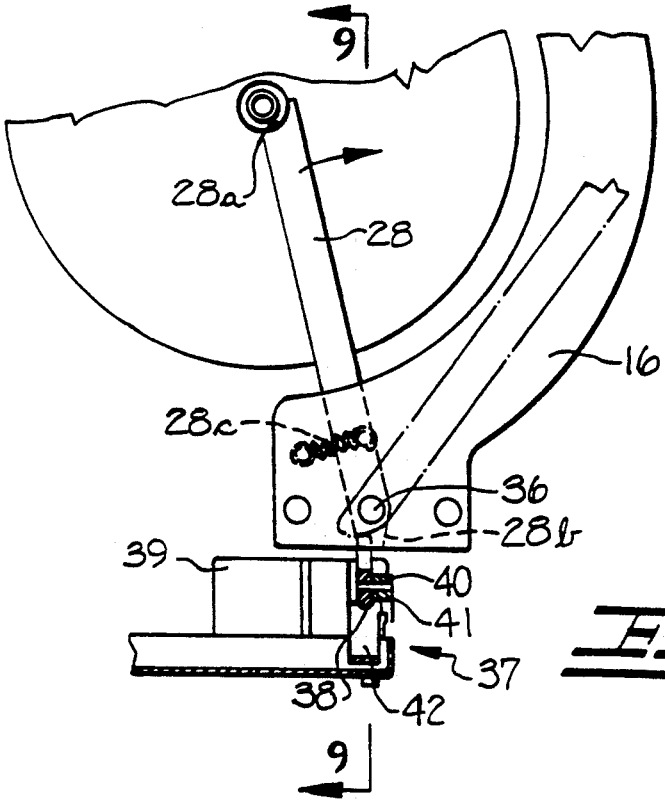
FIG. 8 is a diagrammatic, partial sectional view of the turning lever and the locking and unlocking mechanism for locking the free end of the winding roll with the turning lever.

Winding roll 21 is shown in greater detail in FIGS. 5-7 and 21-24. Winding roll 21 is rotatably supported at one end by a bearing fitted into the frame arm 17. The other end of the winding roll is free. During winding of knitted fabric, the free end of the winding roll is in contact with the tip of a turning lever 28 (FIG. 8). As will be described later in detail, the turning lever 28 is released from the winding roll 21 when the fabric wound on the winding roll is removed.

Figure 5:
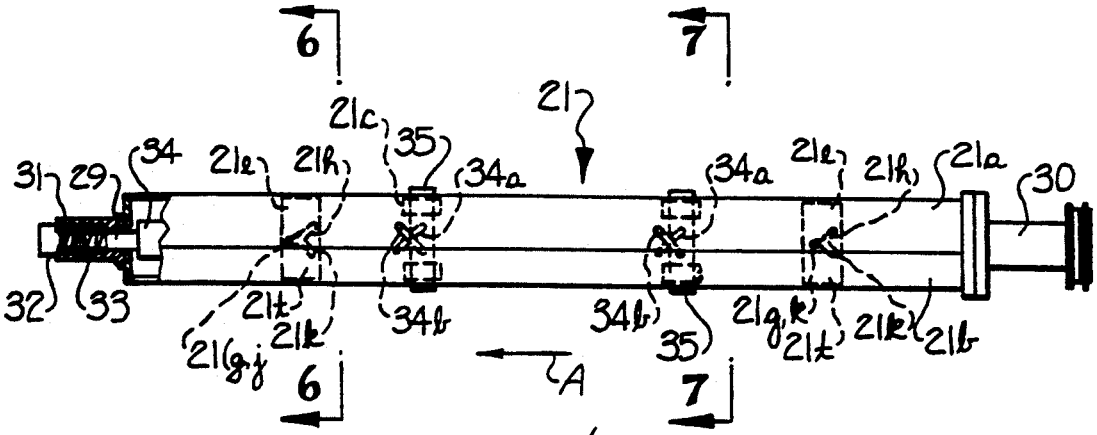
FIG. 5 is a partial sectional view of the winding roll in accordance with the present invention.
Figure 6:
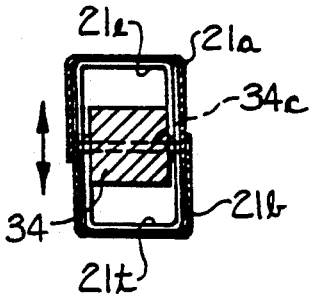
FIG. 6 is a sectional view of the winding roll taken along line 6—6 of FIG. 5.
Figure 7:
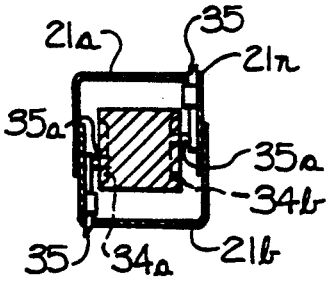
FIG. 7 is a sectional view of the winding roll taken along line 7—7 of FIG. 5.
Figure 21:
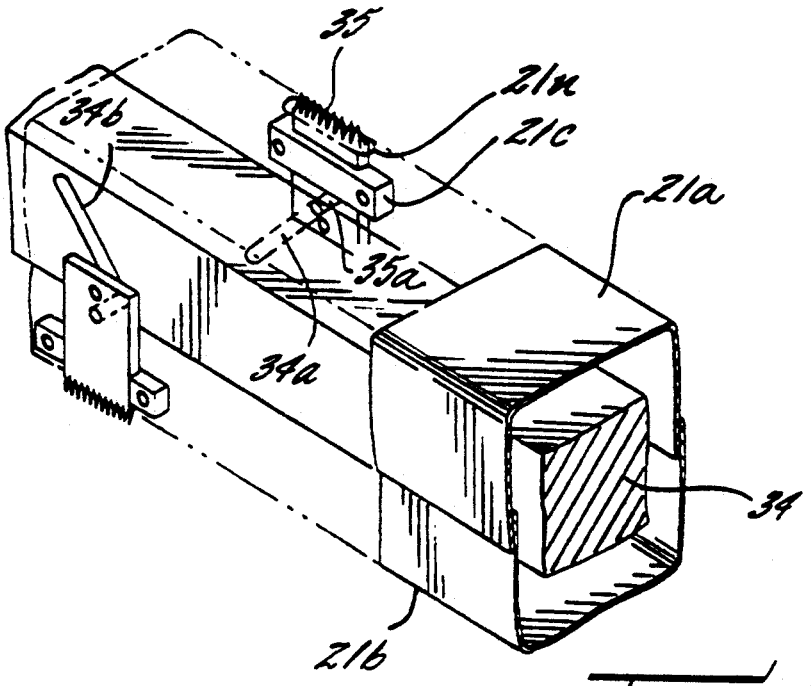
FIG. 21 is a fragmentary perspective view of the winding roll showing the comb mechanism.

As shown in FIG. 5, the winding roll 21 is of rectangular cross-sectional shape. The roll includes rectangular channel members 21*a* and 21*b* which divide the surface of the roll into two half sections and which surround a rectangular elongated shaft 34. Short stub shafts 29, 30 project from opposite ends of shaft 34, and a bearing 31 is mounted on the outer side of the short stub shaft 29. A spring 33 is positioned between a mounting collar 32 and the periphery of the bearing 31. As shown in FIGS. 5 and 21, guide slots 34*a* provided at two spaced locations in shaft 34 are inclined toward the upper right side of the shaft. Other guide slots 34*b* are provided in and inclined to the lower right side of the opposite face of shaft 34.

Small channel members 21*e*, 21*f* are secured on the inside of the channel members 21*a* and 21*b*. The small channel member 21*e* has inclined guide holes 21*h* communicating with horizontal guide holes 21*j*. Small channel members 21*f* has inclined holes 21*k* communicating with horizontal guide holes 21*g*. Pins 34*c* extend through the elongate shaft 34 and extend into the aforesaid horizontal and inclined holes.

Combs 35 are positioned along the winding roll 21, preferably at four spaced locations along its length. Combs 35 normally project from the roll, catch the end portion of the fabric suspended from the knitting unit, and cause the fabric to remain secured to the winding roll 21. When the fabric is being doffed from the winding roll 21, combs 35 are retracted into the winding roll 21 by the same relative movement of the roll components that decreases the diameter of the winding roll.

As seen in FIG. 21, guide slots 34*a*, 34*b* engage pins 35*a* secured to each comb 35. Each comb 35 is guided by a guide plate 21*c* secured on each of the channel members 21*a*, 21*b*. The channel members 21*a*, 21*b* include holes 21*n* into which the comb 35 extends during the normal winding operation of the winding roll 21.

Figure 23:
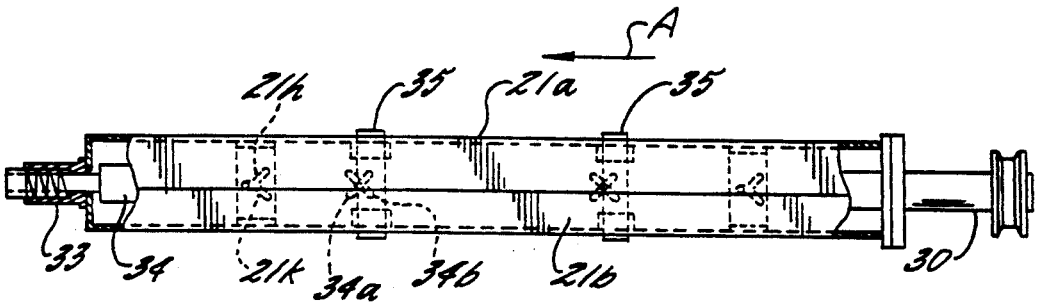
FIG. 23 is a front elevational view showing the winding roll in its normal, larger diameter state with combs extended for winding fabric.
Figure 24:
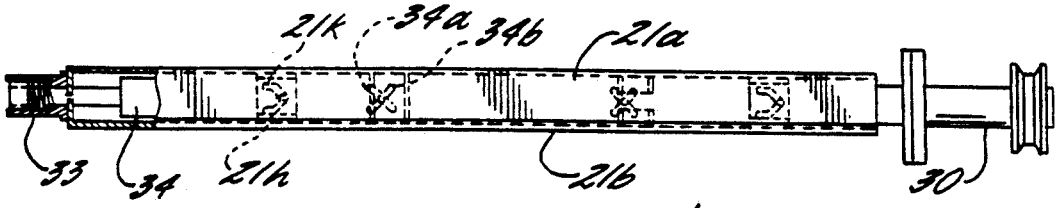
FIG. 24 is a front elevational view showing the winding roll in its reduced diameter shape.

When the channel members 21*a*, 21*b* are moved in the direction of the illustrated arrow in FIGS. 5 and 23, in opposition to the force supplied by spring 33, combs 35 are withdrawn from the surface of the winding roll along the inclining guide holes 34*a*, 34*b*.

Figure 22:
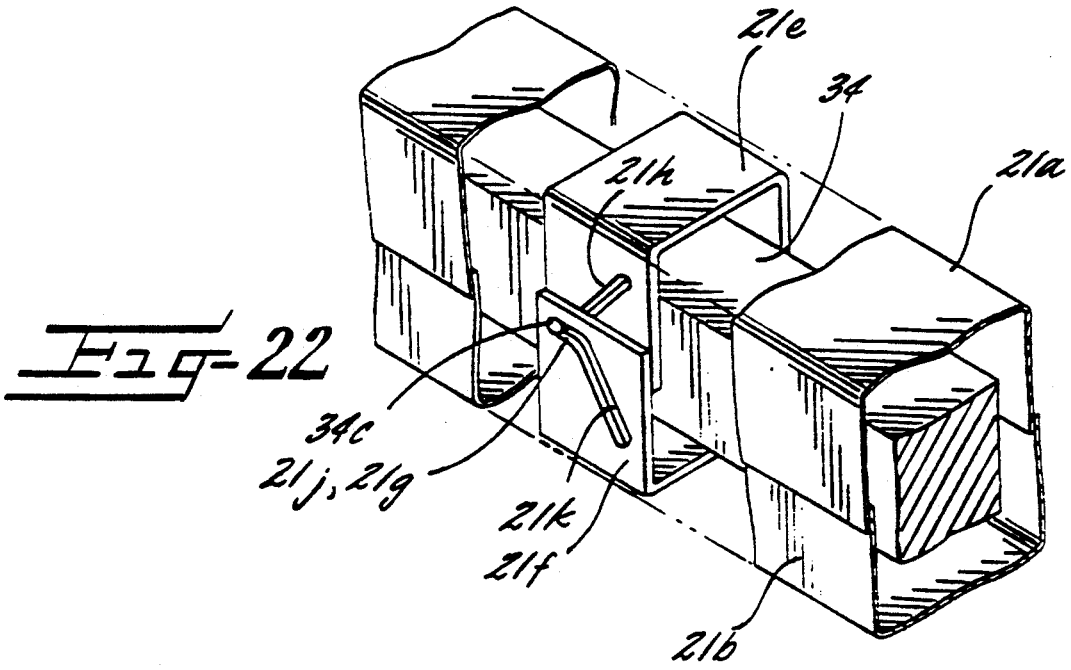
FIG. 22 is a fragmentary elevational view of the winding roll showing the positioning of the guide holes.

The retraction of combs 35 and the diameter reduction motion of the winding roll 21 take place simultaneously in one integral operation. The side of the fabric wound on the winding roll 21 closest to the side of the winding roll 21 attached to the frame arm 17 is in close proximity to doffing plate 49 of doffing mechanism 47. When the doffing plate 49 pushes, by means of the doffing mechanism 47, the rolled fabric axially in the direction of the arrow in FIGS. 5 and 23, pin 34*c*, which fixedly projects from the elongate shaft 34, is guided along the inclining guide holes 21*h* and 21*k* (FIGS. 22 and 23). This movement draws the channel members 21*a* and 21*b* together and thus reduces the diameter of roll 21. Simultaneously, the pin 35*a* fixed to the combs 35 is guided along the inclining guide slots 34*a* and 34*b* of shaft 34 (FIG. 21). This movement retracts combs 35. Thus, the motion of the doffing plate 49 against the fabric in opposition to the force of spring 33 causes both retraction of the combs 35 and change in diameter of the winding roll 21. The knitted fabric is easily removed from winding roll 21 in the direction of the roll axis when the roll diameter is reduced and the combs 35 are retracted.

After the fabric wound on the winding roll 21 is removed, the winding roll 21 is restored to its normal diameter with combs 35 extended by the force exerted by the spring 33. Winding roll 21 is then again ready for winding of the knitted fabric. The doffing mechanism 47 then returns the winding roll to its normal position as described in detail below.

Referring now to FIG. 8, the turning lever 28 supporting the free end of the winding roll 21 is illustrated in greater detail, together with the lever locking mechanism 37 which locks and unlocks the turning lever. Lever 28 is mounted on the frame by a pin 36 positioned in a recess formed on the frame arm 16. The forward portion of the turning lever 28 includes a cut-away, concave portion 28*a*, which supports the free end of the winding roll 21. The other end of the turning lever 28 includes an inclined portion 28*b*. A spring 28*c* between the winding frame arm 16 and lever 28 biases the lever.

Figure 9:
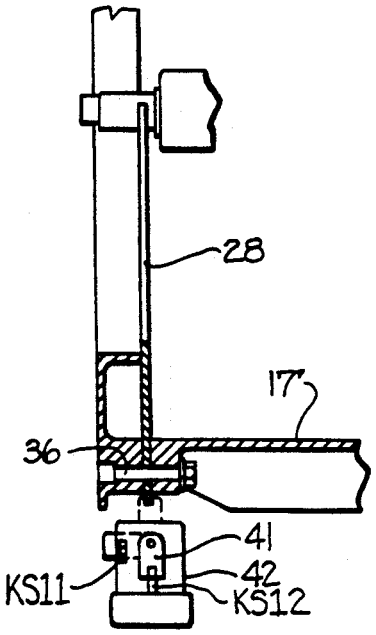
FIG. 9 is a sectional view of the lever arm taken along line 9—9, of FIG. 8.

The locking mechanism 37 is positioned on the lower end of the lever arm 28. Mechanism 37 includes a cam 38 on which the turning lever 28 abuts. A collar 40 aids in supporting the cam 38 and a gear motor 39, which is operatively connected to cam 38. Cam 38 is positioned at 90 degrees relative to a sensor plate 41. When cam 38 is rotated vertically, and turned into a position as shown by the double-dash line, knitted fabric is in position to be doffed. Cam 38 and collar 40 are positioned in a support box 42. Two proximity switches KS11 and KS12 (FIG. 9) are positioned in the support box. The support box is mounted to a base plate.

FIG. 10 shows a side view of the fabric guide mechanism 43. The fabric guide mechanism is positioned above the frame arms 16, 17, and includes a fabric guide plate 44 and spring 45 for pressing the guide plate 44 onto the knitted fabric. The fabric guide plate 44 is rotatably fixed to arms 46 horizontally extending from the frame arms 16, 17. Guide plate 44 presses against the leading end of the knitted fabric at the start of winding, while pressing and stabilizing the wound fabric as the roll of knitted fabric diametrically enlarges. The guide plate 44 moves arcuately while touching the knitted fabric in opposition to the biasing force of the spring 45 as the diameter of the wound knitted fabric roll increases.

Figure 12:
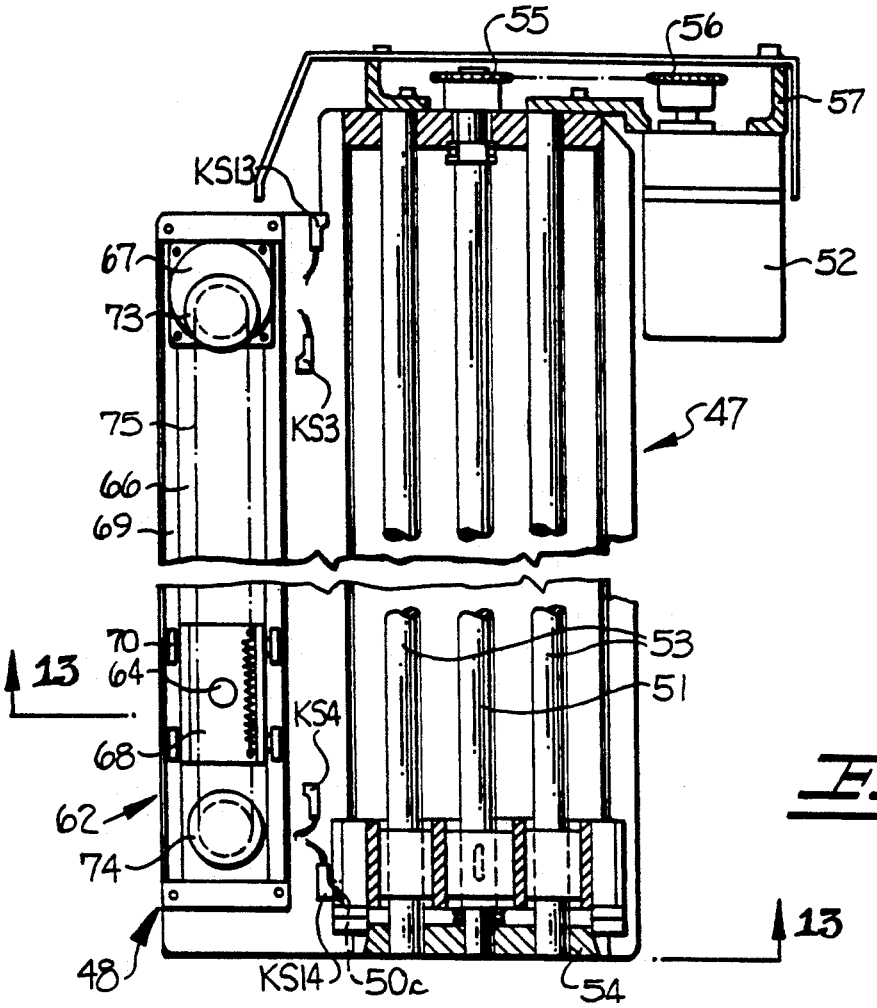
FIG. 12 is a partial sectional view of a portion of the fabric doffing mechanism and the fabric cutting mechanism.
Figure 13:
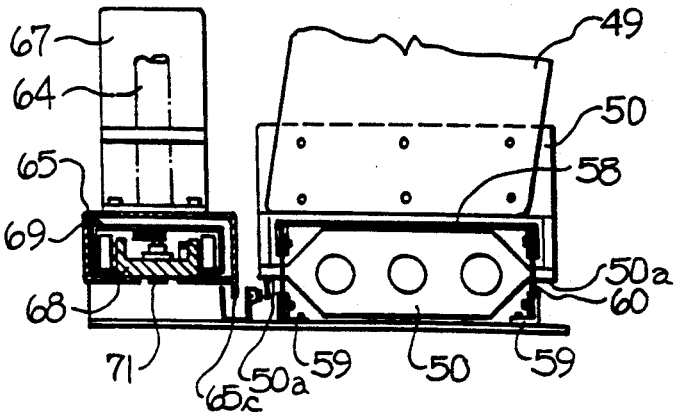
FIG. 13 is a sectional view taken along line 13—13 of FIG. 12.
Figure 25:
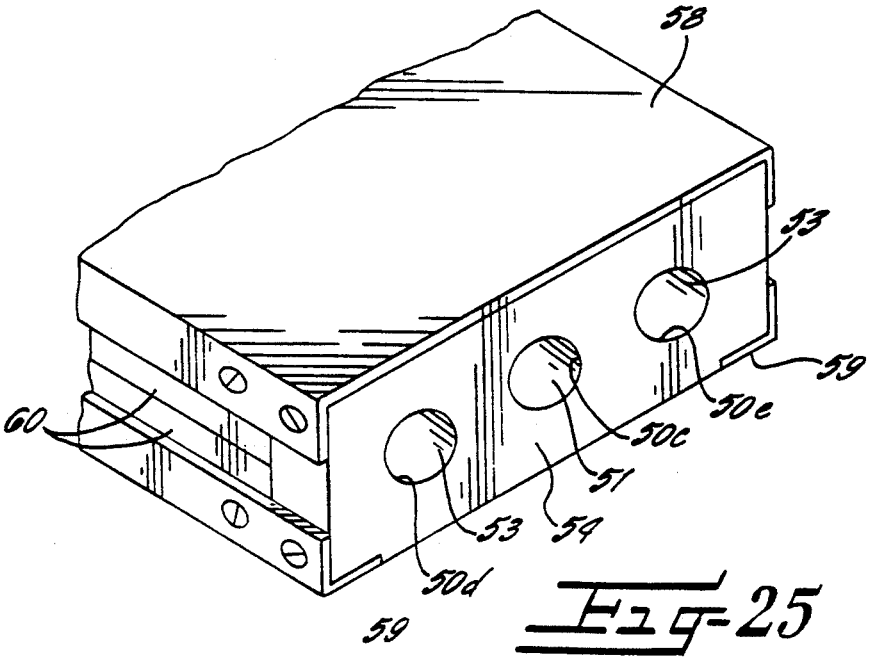
FIG. 25 is a fragmentary perspective view of a movable block member and thereto affixed support members.

Referring now to FIGS. 12, 13, and 25, the fabric doffing mechanism 47 includes a vertically oriented doffing plate 49 which presses the side of the knitted wound fabric on the winding roll 21. Doffing plate 49 is integrally attached to a movable block 50. Movable block 50 has a female screw channel 50*c* that receives the screw 51 which moves the movable block 50, and also has two guide bar channels 50*d* and 50*e*. Screw 51 is driven by motor 52 and meshes with the female screw channel 50*c* in the movable block 50 to provide the motive force to move the block. Two guide bars 53 in parallel with screw 51 are connected to support frame members 54. Movable block 50 is displaceable between support frame members 54.

As seen in FIG. 12, a sprocket wheel 55 is secured onto one end of screw 51 beyond the outer side of the support frame 54. The sprocket wheel is driven by a motor 52 via another sprocket wheel 56 and a chain mechanism. Motor 52 is connected to a motor support frame 57 positioned on the side of the support frame 54.

As shown in FIGS. 13 and 25, a channel configured cover 58 and angle members 59 are connected to the sides of support frame members 54 at upper and lower portions. Both side ends of the cover 58 and angle members 59 are shielded, such as by resilient rubber plates 60, positioned above and below the entrance to prevent fibers from entering. Arms 50*a* on both sides of the movable block 50 extend upwardly beyond the rubber plate 60. A vertical plate 50*b* is connected to the arms 50*a*. Doffing plate 49 is connected to vertical plate 50*b*. The top forward end of the doffing plate 49 extends adjacent winding roll 21 and alongside a roll of the wound fabric (FIG. 4).

A sensor plate 50*c* is connected to the side end portion of the movable block. A proximity switch KS13 detects the positional base point of the movable block 50. A proximity switch KS14 for detecting the most extended use displacement of the block 50 is located opposite the sensor plate 50*c*.

Figure 11:
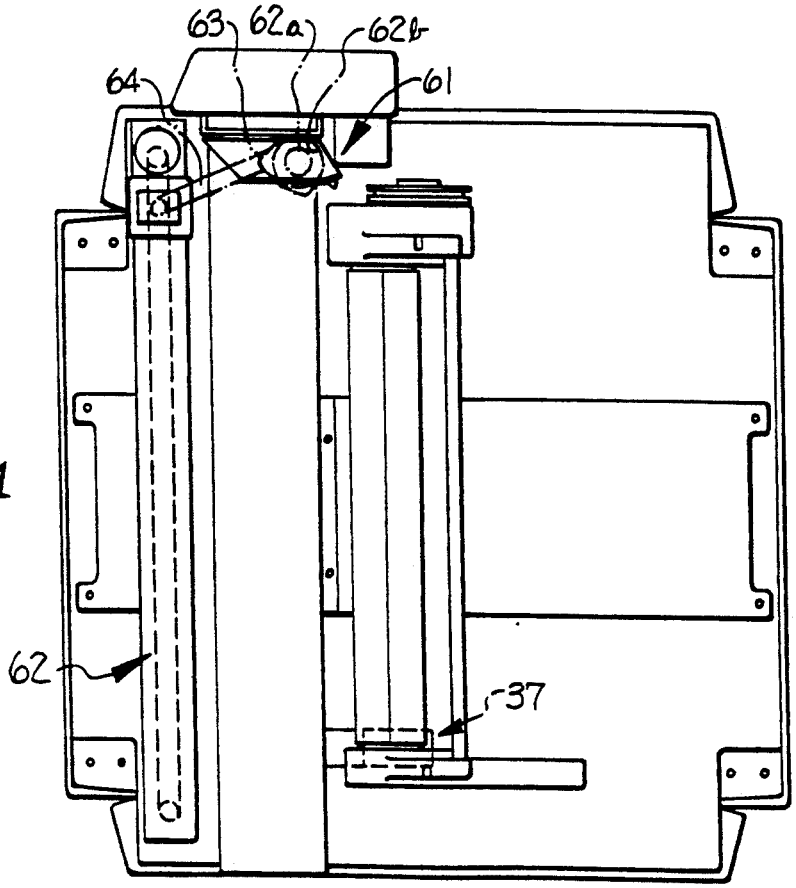
FIG. 11 is a plan view of the winding unit taken along line 11—11 of FIG. 3.

The fabric cutting mechanism 48 of the present invention is shown in FIGS. 4, 11, 12 and 13. The mechanism is positioned outside the fabric doffing mechanism 47, and includes a circular cutter member 62*b*, and a cutter displacement and driving mechanism 62 that includes a motor 62*a* on which the circular cutter 62*b* is fixed (FIGS. 4 and 11). The circular cutter 62*b* includes a cover 63 for protecting the cutter and personnel. The member 63 is supported on a bent, upright stand 64 close to the knitted fabric. Stand 64 is supported on the cutter displacement and driving portion 62, which includes a movable member 65 (FIG. 13), transmission wire belt mechanism 66 (FIG. 12), rail member 69 and a motor 67 for moving these components.

FIGS. 12 and 13 also show a mounting support block 68 connected to the upper side of the bottom portion of the movable member 65 and integral therewith. The block 68 has rollers 70 at both of its sides so that the rail member 69 is displaceable. A power supply brush 71 is connected to the cutter portion, and a motor 67 is drivably connected to rail member 69. Wheels 73, 74 on rail member 69 are interconnected by a pulley belt or wire 75. Pulley wheels 73, 74 are connected to the motor 67 and rail member 69.

Rotation of pulley wheel 73 drives pulley wheel 74 and displaces the mounting support block 68 connected to the pulley wire 75, as well as the movable block 65. A sensor plate 65*c* is connected to the side end of the movable member 65. A proximity switch KS3 (FIG. 12) detects the positional base point of the movable member 65. A proximity switch KS4 detects the terminal point of displacement of the member opposite the sensor plate 65*c*.

Figure 14:
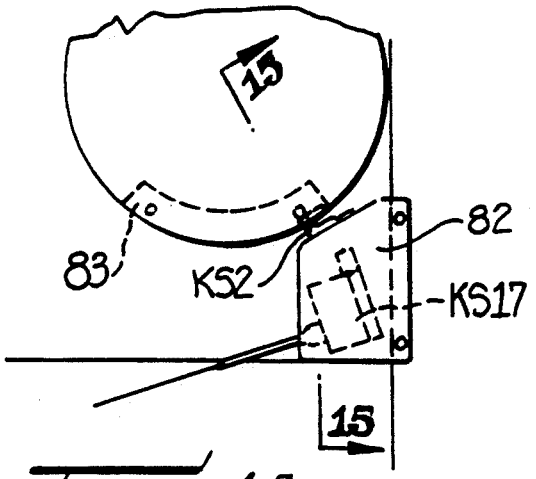
FIG. 14 is a plan view of a switch used for stopping the winding roll after a predetermined amount of fabric has been wound thereon.
Figure 15:
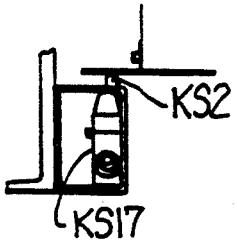
FIG. 15 is an end elevational view of the switch taken along line 15—15 of FIG. 14.

FIG. 14 shows in plan a proximity switch KS2 for stopping the winding roll and detecting the knitted fabric. Proximity switch KS2 allows stopping of the winding roll at a fixed position. The proximity switch is connected to the side of the box 82 at a position in close proximity to the winding unit 4. A sensor plate 83 is connected to the bottom of the winding unit 45. A micro switch KS17 is contained in a containment box secured to the base plate.

Figure 16:
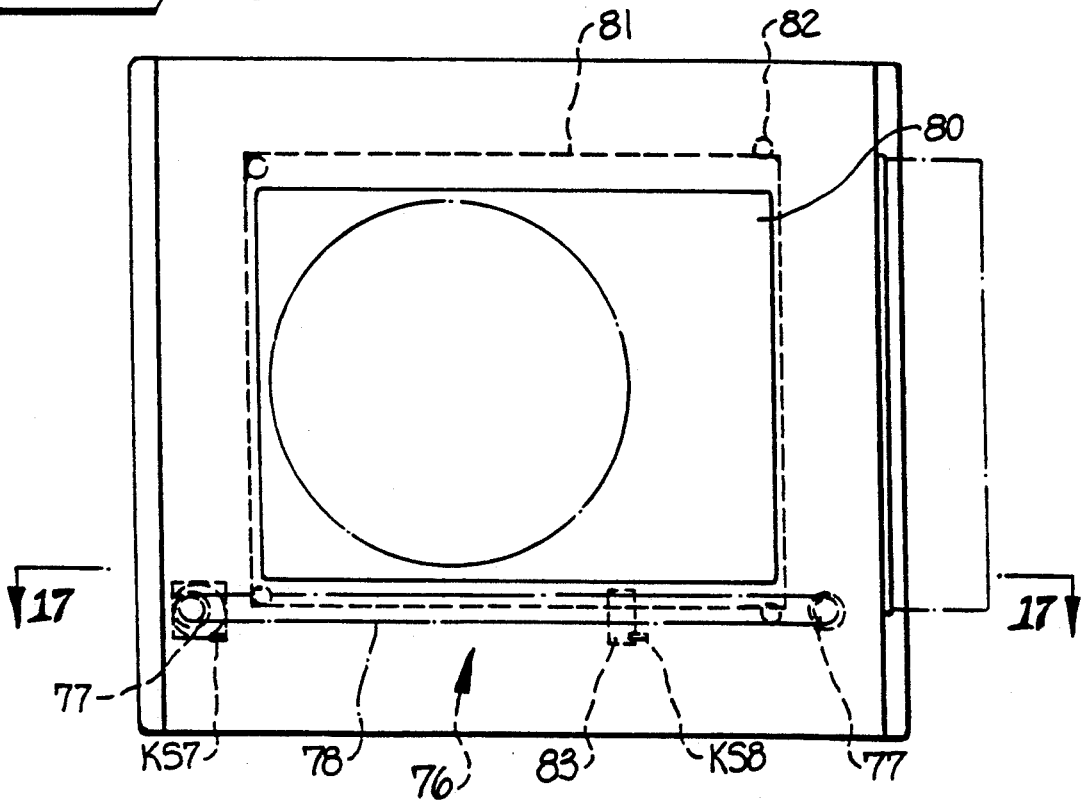
FIG. 16 is a front view of gate opening means associated with the doffing mechanism.
Figure 17:
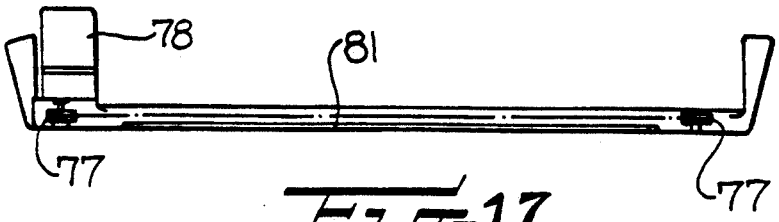
FIG. 17 is a top plan view taken along line 17—17 of FIG. 15.

Referring now to FIGS. 16 and 17, details of the gate opening and closing mechanism 76 are illustrated. The gate opening and closing mechanism 76 includes a transmission motor 78 and a window portion 80. Below window portion 80 are pulley wheels 77 and a pulley wire 78 that extends between and around the pulley wheels.

Figure 2:
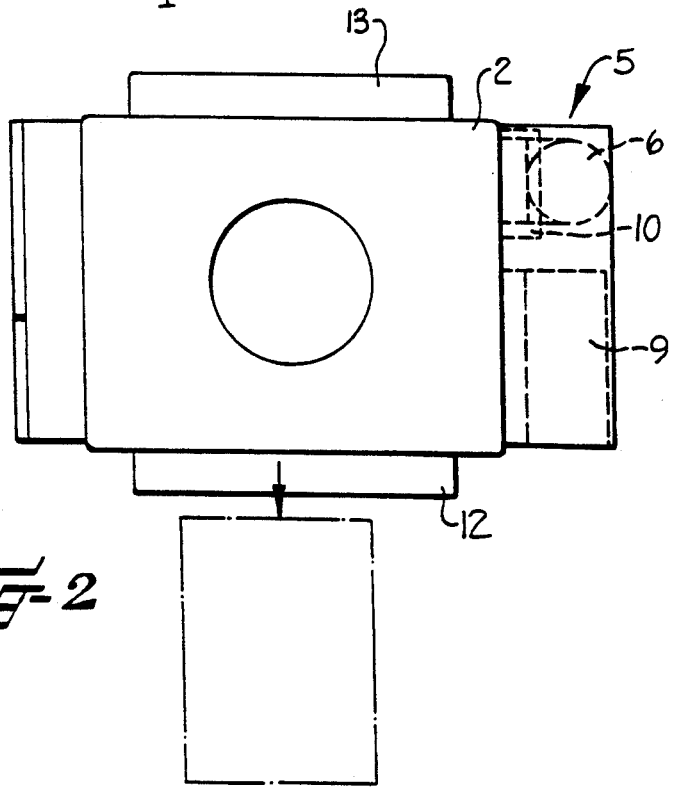
FIG. 2 is a plan view of the knitting machine taken along line 2—2 of FIG. 1.

Motor 78 drives one of the pulley wheels 77. A transparent slide 81 is connected to the pulley wire. The slide 81 moves as the pulley wire moves right and left. The slide 81 is larger in size than the window portion 80 and is supported by guide rollers 82 positioned on right and left corners. The dash line drawn in the window portion of FIG. 16 indicates a knitted fabric wound on the winding roll 21. The fabric is doffed to a position shown in FIG. 2 across from the window portion 80 when pushed by the doffing mechanism 47. Afterward, the doffed fabric is conveyed by a cart, belt conveyor or the like (not shown) to a position for subsequent processing.

A sensor plate is integrally fixed to the lower end of the slide 81. On the plate, proximity switches KS7 and KS8 (FIG. 16) are fixed for detecting the positional base point of the plate 83 and the terminal point of displacement.

Figure 18:
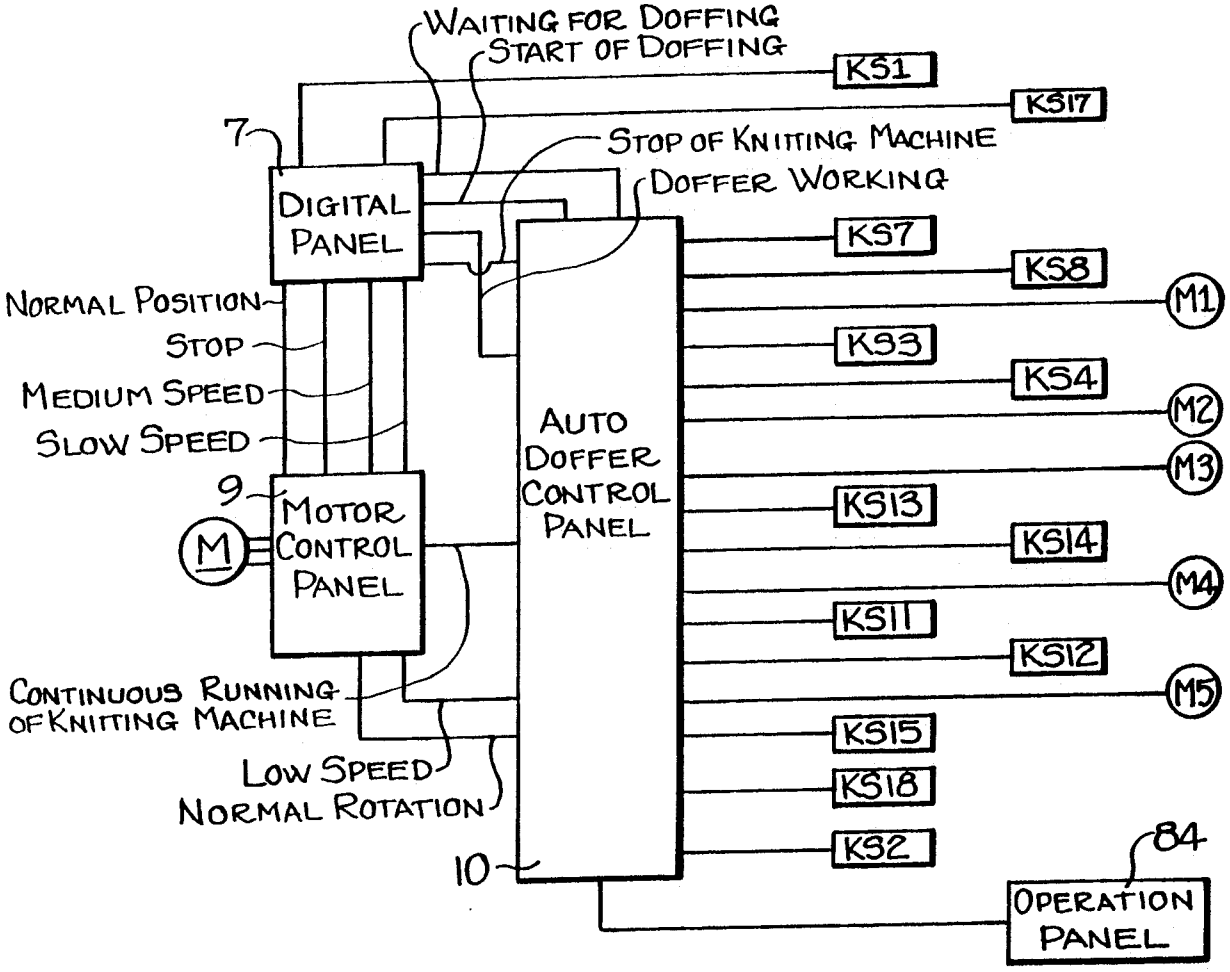
FIG. 18 is a block diagram showing the signal transmission for controlling operation of the automatic winding and doffing apparatus of the present invention.

FIG. 18 is a block diagram illustrating the signal transmission route for controlling the automatic winding and doffing mechanism 47. Referring to the drawing, a console of the digital panel mechanism 7 comprises a 10-key pad into which preset values and motor speed control values for the knitting machine are input. The digital panel includes function keys, monitors and trouble shooting lamps. A central processing unit (hereinafter referred to as "CPU") (not shown) performs processing in accordance with the pre-input sequence control program. The CPU is positioned in the digital panel 7.

The digital panel is connected to the ACI motor control panel 9 and doffer control panel 10. ACI control panel 9 and auto doffer control panel 10 are connected to each other. The ACI motor control panel 9 is connected to the motor M of the knitting machine for controlling the machine.

The auto doffer control panel 10 has the following components connected thereto: 1) proximity switches KS7 (base point) and KS8 (terminal point) for confirming positions of the gate opening and closing; 2) gate opening-closing motor M1; 3) proximity switches KS3 (base point) and KS4 (terminal point) for confirming a position of the fabric cutting device 48; 4) fabric cutter displacing motor M2 and cutter motor M3; 5) proximity switches KS13 (base point) and KS14 (terminal point) for confirming a position of the fabric doffing device; 6) motor M4 for displacing the fabric doffing device; 7) proximity switches KS11 (base point) and KS12 (terminal point) to confirm a locking-unlocking position for locking and unlocking the winding roll; 8) motor 5 for locking and unlocking the winding roll; and 9) proximity switch KS2 for confirming stop of the winding unit at a fixed position. These mechanisms and components transmit signals detected thereby to the auto doffer control panel.

When the mechanisms connected to the auto doffer control panel 10 are operational, corresponding signals indicating that the doffer is in operation are transmitted to the digital panel device 7.

When operational trouble occurs in the mechanisms connected to the auto doffer control panel 10 and in the yarn feeding system, signals enabling the doffer to halt (wait) operation are transmitted from the digital panel device 7 to mechanisms connected to the auto doffer control panel 10.

The ACI motor control panel 9 transmits to the auto doffer control panel 10 signals obtained from mechanisms connected to the auto doffer control panel 10, indicating that the knitting machine is rotating.

Signals from proximity switch KS1 indicating the speed and number of revolutions of the knitting machine are transmitted to the CPU of the digital panel device 7. The output side of the CPU is connected to motor M of the knitting machine through the ACT motor control panel 9.

Signals from proximity switch KS1 control the speed of motor M of the knitting machine, for example, three steps as normal, medium, and low modes, with the ROM incorporated into the ACI motor control panel 9 and programmed beforehand. Proximity switch KS1 is connected to the auto doffer control panel 10 through the digital panel device 7.

When the number of detected revolutions of the knitting machine reaches a preset value, stop signals are transmitted to the ACI motor control panel through the digital panel device 7. The stop signals transmitted to the ACI motor control panel 9 are transmitted as retardation signals to the motor M connected to the output side of the ACI motor control panel 9 to stop the knitting machine at a fixed position after driving at low speed.

When the knitting machine is stopped, proximity switch KS2 detects the fixed stop position of the winding unit. Fixed position stop signals are transmitted to the auto doffer control panel 10. The fixed position stop signals of the winding unit 4 transmitted to the auto doffer control panel 10 are in turn transmitted to a mechanism connected to the output side of the panel 10 and then further transmitted to the mechanism after completion of an operation of one mechanism performed in the order of desired operations.

A microswitch KS17, for confirming that the fabric is wound on the winding roll 21, is connected to the digital panel 7. The switch KS17 operates when winding of the fabric on the winding roll 21 fails. At that time stop signals are transmitted to the digital panel 7 to stop the motor M connected through the ACI motor control panel 9, as well as the other mechanisms connected to the auto doffer control panel 10.

An operation panel 84 enables full automatic operation and allows a series of mechanisms to automatically operate, and operate in semi-automatic operation, as well as to allow each mechanism to operate independently from the others when improper operation is caused, and manual operation is fixed to the auto doffer control panel 10.

Figure 19:
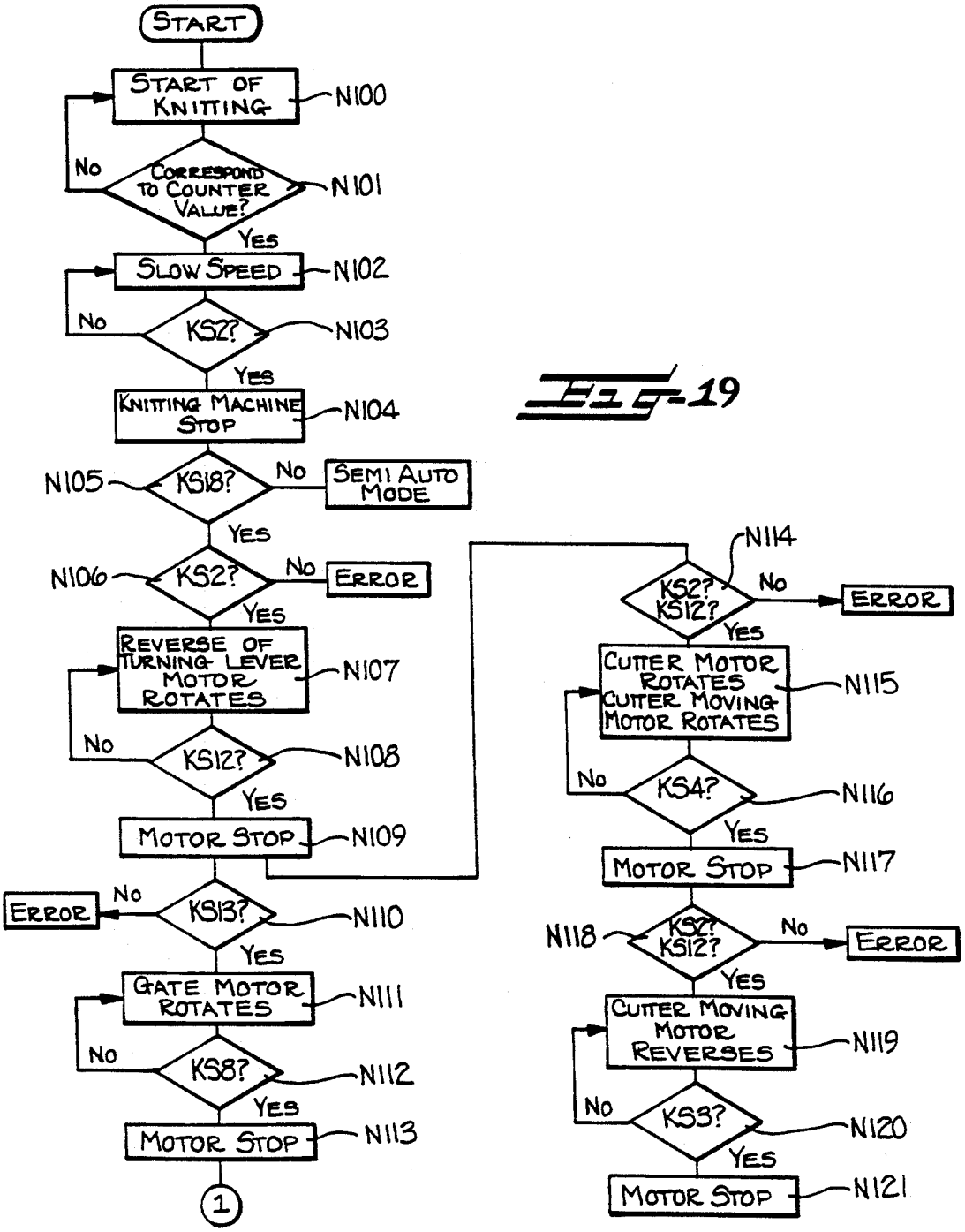
FIGS. 19 and 20 are block diagrams showing operation of the automatic fabric winding apparatus in accordance with the present invention.
Figure 20:
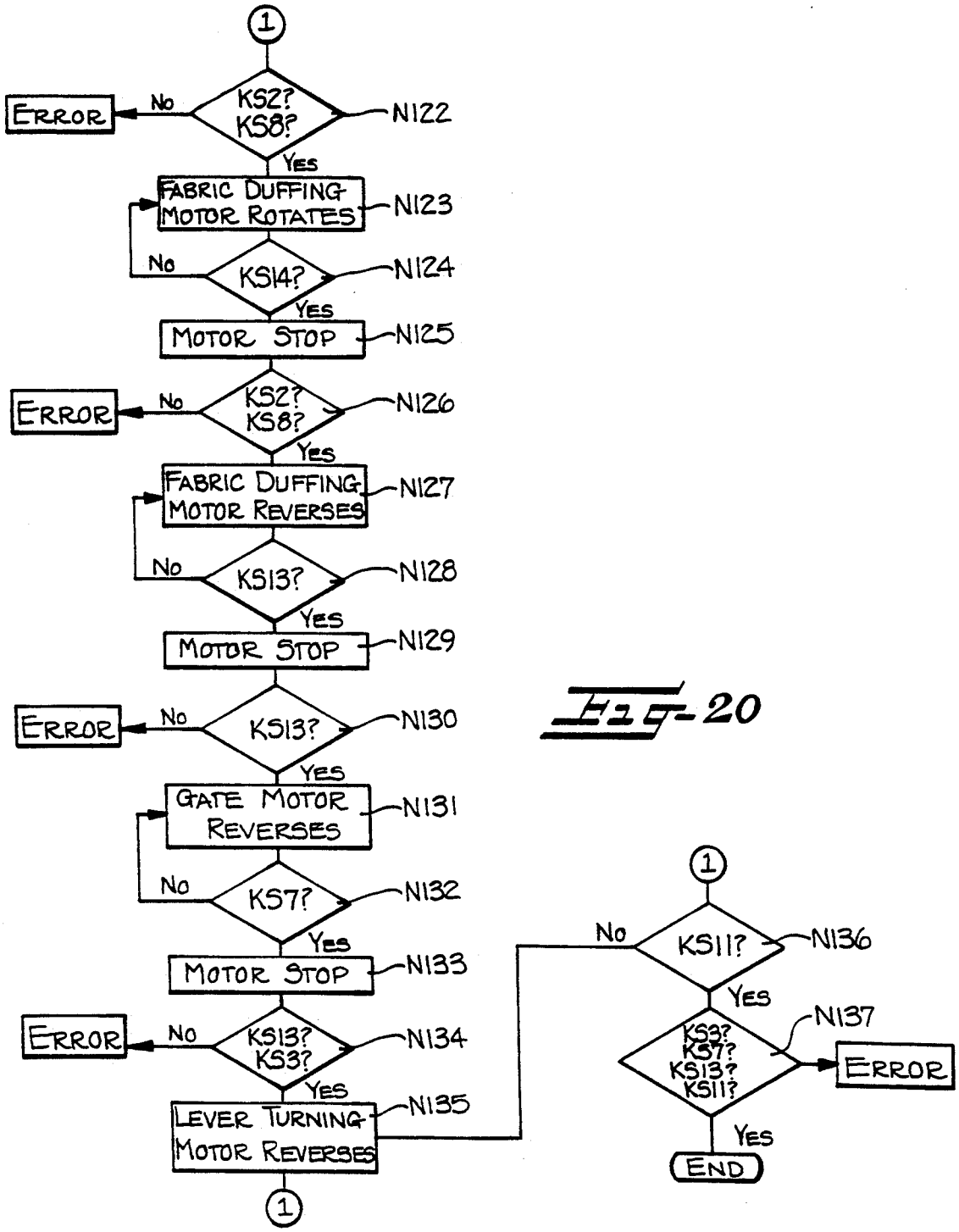

A detailed description of operations of the automatic fabric winding mechanism of this invention on the circular knitting machine will now be made with reference to a flow chart shown in FIG. 19. The reference numbers N100 to N200 represent steps in the flow chart.

When the knitting machine is started, a preset counter of the digital panel 7 begins counting, and the proximity switch KS1 inputs the signals indicative of the number of revolutions of the knitting machine into the CPU of the digital panel 7. An accumulated value of the number of revolutions is calculated for comparison with a sequence process algorithm inputted beforehand (N step 100).

In the N step 101, the number of revolutions of the knitting machine is compared With a preset value to determine if the number of revolutions has reached that value. When the number of revolutions reaches the preset value, the motor is retarded according to an instruction of the motor control panel, placing the knitting machine in the low speed driving mode (N 102). When the number of revolutions is under the preset value, the knitting machine continues operating.

In the N step 103, the winding unit has reached the fixed stop position. Proximity switch KS2 determines the fixed stop position.

In the N step 104, if the winding unit reaches the fixed position, the knitting machine is stopped. If the winding unit has not reached the fixed position, the machine is driven at low speed until the unit reaches the fixed position.

In the N step 105, the switch KS18 compares the diameter of the fabric package with a standard value of, e.g., 200 mm.

If the diameter of the fabric package is more than 200 mm, the operation is shifted to the N step 106 in which the proximity switch KS2 determines when the fabric package is in the fixed position. When the diameter is less than 200 mm, the operation is checked with the semi-auto mode. If the winding unit is not in the fixed position, error is implied, and the operator performs checking.

In the N step 107, when the winding unit is stopped in the fixed position, the gear motor 5 of the lever locking and unlocking mechanism 37 is driven. This causes cam 38, which is fitted onto the shaft of the gear motor 5, to turn by 90° in the vertical direction and abut the turning lever 28, for turning the lever and releasing the free end of the winding roll 21.

In the N step 108, the proximity switch KS12 determines the position in which the turning lever 28 turns for locking and unlocking the winding roll 21.

When the turning lever 28 has been turned to the fixed position, the operation is shifted to the N step 109 and the geared motor M5 is stopped. Driving of the geared motor M5 continues if the turning lever 28 has not turned to the fixed position.

After the geared motor M5 has stopped, operations in the N step 110 through 113 for opening the lower gate 13, and the N step 114 through 117 for driving the cutter motor 62 of the fabric cutting device 48 and the cutter displacing motor 52, proceed simultaneously.

In the N step 110, determinations are made as to whether the proximity switch KS2 for stopping the winding unit 4 at the fixed position is operative and the switch KS12 for locking-unlocking the winding roll is operative.

When the proximity switch K2 for stopping the winding unit 4 at the fixed position, and the KS12 switch for locking-unlocking the winding roll 21, are operative, the motor M1 for opening and closing the gate 13 opens gate 13 (N step 111). A contrary result implies error and the operator performs checking.

In the N step 112, the proximity switch KS8 determines whether the gate 13 has been opened. If the gate has been opened, the operation is shifted to the N step 113 in which the gate opening-closing motor M1 is stopped. If the gate has not been opened, the gate opening-closing motor M1 continues rotating until the gate is opened.

In the N step 114, determinations are made as to whether the proximity switch KS2 for stopping the winding unit 4 at the fixed position is operable, and whether the KS12 switch for locking-unlocking the winding roll 21 is operable.

When the proximity switches KS2 (fixed position stopping of the winding unit 4) and KS12 switch (for locking-unlocking the winding roll 21) are determined operable, the cutter motor M3 and cutter displacing motor M2 are enabled. If the switches are not operable, error is implied and the operator checks for error. In the N step 116, a determination as to whether the fabric cutting mechanism 48 has reached the terminal point is made.

In the N step 117, if the fabric cutting mechanism 48 has reached the terminus, the cutter displacing motor M2 stops; otherwise, the cutter displacing motor M2 continues operation.

In the N step 118 the cutter displacing motor M2 rotates in the reverse direction to return the cutter to the initial base position (N step 119) if the proximity switch KS2 for the fixed position stop of the winding unit 4 and the KS12 switch for locking-unlocking of the winding roll 21 are determined to be in operation: otherwise, error is implied and the operator performs checking.

In the N step 120, if the cutter has returned to its initial base position, the cutter displacing motor M2 is stopped (N step 121); otherwise, the cutter displacing motor M2 continues operation.

In the N step 119, when the proximity switch KS2 for the fixed position stop of the winding unit 4 and the switch KS12 for opening and closing the gate 13 are in operation, the step is shifted to the N 123 step in which the motor for doffing the fabric is driven to push the fabric on the winding roll 21 outside of the machine so that the fabric may be doffed.

In the N step 124, if the fabric doffing position 47 is at the terminal position, the fabric doffing motor M4 is stopped (N step 125); otherwise, the fabric doffing motor M4 is stopped.

In the N step 126, if the winding unit is in the fixed, stop position, and the gate 13 is opened for the fixed position stop of the winding unit 4, the fabric doffing motor is rotated in the reverse direction and the fabric doffing mechanism 47 returns to the initial base position (N step 127); otherwise, error is implied and the operator performs checking.

In the N step 128, if the fabric doffing mechanism 47 has returned to the initial base position as determined by the switch KS13, the motor for the fabric doffing device 17 is stopped (N 129); otherwise, driving of the motor for the fabric doffing device 47 continues.

In the N step 130, the switch KS13 determines whether the motor M4 for fabric doffing has terminated. If that motor is off, the motor M1 for opening and closing gate 12 is rotated in the reverse direction so that the gate 12 is displaced to the initial closure position; otherwise, error is implied and the operator performs checking.

In the N step 132, if the gate has been closed, the motor M1 for opening and closing the gate 13 is stopped.

In the N step 134, if the doffing device 47 and cutter are in fixed stop positions as determined by the switch KS13 (confirming the base point of the mechanism 47) and KS3 (confirming the base point of the cutter), the motor M5 for actuating a locking-unlocking cam 38 for the winding roll 21 is rotated in the reverse direction and the winding roll 21 is turned and locked by the turning lever 28 (N step 135); otherwise, error is implied and the operator performs checking.

In the N step 136, the fabric retention confirming switch KS11 determines whether the turning lever 28 for locking-unlocking of the winding roll locks the winding roll.

In the N step 137, if the turning lever 28 is retaining the winding roll, other mechanisms and components are sensed to determine whether they are stopped: the driving part for displacing the cutter; the closure of the gate 13; the locking of the winding roll by the locking-unlocking cam 38; and whether the fabric doffing device is stopped or performed in base positions. If the above mechanisms are stopped, the knitting machine is started again; otherwise, error is implied, and the operator performs checking.

The invention provides the benefits and advantage of relieving the knitting machine operator of heavy labor normally associated with conveyance of the knitted fabric roll, and enhances knitting machine operation.

The foregoing embodiments are to be considered illustrative, rather than restrictive of the invention and those modifications which come within the meaning and range of equivalents of the claims are to be included therein.

That which is claimed is:

1. An apparatus for automatically winding and doffing fabric knitted on a circular knitting machine having a needle cylinder, fabric delivery rolls, and a winding unit disposed below and revolving synchronously with said cylinder, said fabric delivery rolls being driven by said winding unit through a power transmission mechanism interconnected to the revolving winding unit, comprising:

a frame having two opposed arms;

a rotatable fabric winding roll for winding knitted fabric, means for rotating said winding roll, said winding roll having a central axis and two opposed ends, and including means for changing a diameter of the roll so as to facilitate doffing from the roll of fabric wound thereon, and comb means adjacent a surface of the roll and movable from a retracted position below the surface to an extended position projecting from the surface of the roll for engaging the fabric and retaining the fabric on the winding roll;

means pivotally connecting one end of the winding roll to one of the arms;

means for guiding fabric to the winding roll;

means for stopping rotation of the fabric winding roll after a predetermined amount of fabric has been wound on the roll;

cutting means for cutting the fabric; and fabric doffing means for doffing the fabric from the winding roll in the direction of the roll axis after a fixed length of fabric has been wound on the roll, said fabric doffing means including a fabric doffing member, means mounting said doffing member for movement along a path of travel extending in adjacent generally parallel relationship to said winding roll, and drive means for driving said fabric doffing member along said path of travel.

2. An apparatus according to claim 1, and further comprising a gate positioned adjacent the winding unit between the frame arms for protecting and substantially covering the winding unit, and including means for automatically opening and closing the gate when doffing the knitted fabric from the winding roll.

3. An apparatus according to claim 1, wherein the winding roll comprises two channel members dividing the surface of the winding roll into two half sections, and including means for moving the half sections relative to each other for changing the cross-sectional size of the winding roll.

4. An apparatus according to claim 1, wherein one of the frame arms is substantially C-shaped.

5. An apparatus according to claim 1, wherein the means for cutting the fabric is spaced from the fabric winding roll of the winding unit.

6. An apparatus for automatically winding and doffing fabric knitted on a circular knitting machine having fabric delivery rolls, a needle cylinder, and a fabric winding and doffing unit disposed below and revolving synchronously with the cylinder, and which drives the fabric delivery rolls through a power transmission mechanism interconnecting to the revolving winding unit, comprising:

a frame having two opposed arms;

a rotatable fabric winding roll for winding knitted fabric;

means for rotating the roll;

said roll having two opposed ends and a central axis, and including means for changing the diameter of the roll to allow fabric wound thereon to be doffed therefrom, comb means adjacent a surface of the roll and movable from a retracted position below the surface to an extended position projecting from the surface of the roll for engaging a the fabric and retaining the fabric on the winding roll;

means pivotally connecting one of the ends of the winding roll to one of the arms;

a pivotally mounted turning lever supporting the other of the ends of the winding roll for movement from a home, winding position to an unloading, doffing position;

means for guiding fabric to the winding roll during fabric winding;

means for stopping rotation of the fabric winding roll after a predetermined amount of fabric has been wound thereon;

means for cutting the fabric after said predetermined amount of fabric has been wound upon the roll; and fabric doffing means for doffing the fabric from the winding roll, said doffing means including a doffing member mounted for movement along a path of travel generally parallel to said roll, and drive means for moving said doffing member along said path of travel.

7. An apparatus according to claim 6, further comprising locking means operatively connected to the turning lever for locking the turning lever in a position in which the turning lever supports the winding roll in the home, winding position and for unlocking the turning lever to allow the turning lever to pivot and disengage from the winding roll, said locking means including a cam on which the turning lever abuts, and including motor means operatively connected to the cam for rotating the cam for turning the lever arm.

8. A fabric winding roll according to claim 6, wherein the winding roll comprises two channel members dividing the winding roll into two half sections, and including means for moving the half sections relative to each other for changing the cross-sectional size of the winding roll.

9. A fabric winding roll according to claim 8, wherein the channel members of the winding roll include guide channel members having holes, and wherein the half section channel members engage the guide channel members and are guided along the holes when the cross-sectional size of the winding roll is changed.

10. A method of automatically winding and doffing fabric knitted on a circular knitting machine, comprising the steps of:

guiding the knitted fabric to a rotatable winding roll having a variable diameter and positioned between opposed winding apparatus frame arms;

catching the fabric on the winding roll by engaging the guided fabric on a plurality of combs that are positioned on the winding roll and that extend beyond the peripheral surface of the winding roll;

winding the fabric on the winding roll;

detecting the length of fabric wound onto the winding roll;

reducing the diameter of the winding roll;

doffing the fabric from the winding roll by activating a motor driving a reciprocatorily movable doffing member along a path of travel adjacent the winding roll and against a side of the fabric wound upon the winding roll; and opening a gate which covers and protects the winding roll to allow the knitted fabric to be doffed from the machine.

* * * * *

UNITED STATES PATENT AND TRADEMARK OFFICE

CERTIFICATE OF CORRECTION

PATENT NO. : 5,224,362
DATED : July 6, 1993
INVENTOR(S) : Sawazaki, et. al.

It is certified that error appears in the above-indentified patent and that said Letters Patent is hereby corrected as shown below:

On the Title page, item [56] under References, "8/1978" should be --12/1974-- "Scherzinger" should be -- Scherzinger, et al. --.

Column 2, line 59, omit the comma (,) after "9-9".

Column 3, line 35, "Cross" should be -- cross --.

Column 3, line 50, omit the comma (,) after "as".

Column 4, line 6, "16" should be -- 26 --.

Column 4, line 7, "17" should be -- 27 --.

Column 8, line 26, after "panel" insert -- 9 --.

Column 9, line 4, "With" should be -- with --.

Column 9, line 54, after "roll" insert -- 21 --.

Column 10, line 24, the colon (:) should be a semi-colon (;).

Column 10, line 52, "17" should be -- 47 --.

UNITED STATES PATENT AND TRADEMARK OFFICE

CERTIFICATE OF CORRECTION

PATENT NO. : 5,224,362
DATED : July 6, 1993
INVENTOR(S) : Sawazaki, et. al.

It is certified that error appears in the above-indentified patent and that said Letters Patent is hereby corrected as shown below:

Column 12, line 34, omit "a".

Signed and Sealed this

Fifteenth Day of March, 1994

*Attest:*

*Attesting Officer*

Bruce Lehman

BRUCE LEHMAN

*Commissioner of Patents and Trademarks*